US010378850B1

(12) United States Patent
Young et al.

(10) Patent No.: US 10,378,850 B1
(45) Date of Patent: Aug. 13, 2019

(54) APPARATUS AND METHOD FOR COLLECTING AND THROWING A FLUID

(71) Applicants: Troy Matthew Young, State College, PA (US); Brooke Therese Young, State College, PA (US)

(72) Inventors: Troy Matthew Young, State College, PA (US); Brooke Therese Young, State College, PA (US)

( * ) Notice: Subject to any disclaimer, the term of this patent is extended or adjusted under 35 U.S.C. 154(b) by 0 days.

(21) Appl. No.: 16/001,404

(22) Filed: Jun. 6, 2018

Related U.S. Application Data

(60) Provisional application No. 62/710,808, filed on Feb. 28, 2018.

(51) Int. Cl.

| | |
|---|---|
| ***F41B 3/00*** | (2006.01) |
| ***F41B 3/04*** | (2006.01) |
| ***A63H 33/18*** | (2006.01) |
| ***A63H 23/10*** | (2006.01) |

(52) U.S. Cl.
CPC ..... *F41B 3/04* (2013.01); *A63H 23/10* (2013.01); *A63H 33/18* (2013.01); *F41B 3/00* (2013.01); *A63F 2250/0421* (2013.01)

(58) Field of Classification Search
CPC ..... F41B 3/00
See application file for complete search history.

(56) References Cited

U.S. PATENT DOCUMENTS

| | | | | |
|---|---|---|---|---|
| 1,866,158 A * | 7/1932 | Goodwin | A63B 59/20 473/513 |
| 2,253,688 A * | 8/1941 | Collins | A01K 97/04 24/129 D |
| 2,311,160 A * | 2/1943 | Dobbelaar | F41B 3/00 124/5 |
| 5,224,703 A * | 7/1993 | Osher | A63B 60/10 473/513 |
| 5,427,084 A * | 6/1995 | Arnold | F41B 3/00 124/4 |
| 8,104,459 B2 * | 1/2012 | Young | F41B 3/04 124/1 |

* cited by examiner

*Primary Examiner* — John A Ricci
(74) *Attorney, Agent, or Firm* — Drinker Biddle & Reath LLP

(57) ABSTRACT

A fluid throwing apparatus with a base that is made from substantially fluid-tight flexible material. A handle is attached to the base, which is preferably flexible (or has some flexibility), which when attached to the base causes the base to form into a cup or scoop shape when it is at least partially filled with a fluid and held above the ground. When thrown, the fluid is carried by the base and then released. Depending upon the use of the fluid throwing apparatus, the fluid release could be due to direct impact, or due to unstable flight of the system, such as deformation of the base or the momentum of the mass of fluid. In some embodiments the unstable flight may be induced by optionally attached drag components. In another embodiment the edge/rim of the base could be attached to a player and, when thrown, the attachment would pull back on an edge/rim of the base to release the fluid.

20 Claims, 7 Drawing Sheets

APPARATUS AND METHOD FOR COLLECTING AND THROWING A FLUID

RELATED APPLICATION

This application is related to and claim priority from U.S. Provisional Patent Application No. 62/710,808, filed on Feb. 28, 2018, the disclosure of which is incorporated herein by reference in its entirety.

FIELD OF THE INVENTION

The present disclosure relates generally to toy fluid dispensing systems and more particularly, to a system and method for tossing water for amusement.

BACKGROUND

For many decades, children and adults have found amusement in causing water to be thrown on others. One common system for providing such entertainment has been through the use of fluid filled balloons or bags. In these systems, the balloon or bag functions as a container that is filled, carried, thrown, and, eventually, dispenses, releasing and dispersing the fluid over some area.

Filling such balloon/bags can be tedious if individual units are filled. This is especially the case with water balloons which need to be attached to a spigot for filling. Utilizing auxiliary filling devices may increase filling speeds but may also significantly increase costs and waste materials. Sealing a water filled container can be tedious, resulting in many cases water falling onto the person filling the container. Self-sealing containers often leak and are many times more expensive.

Additionally, high pressure water sources are required to fill water balloons, which limits available filling locations. Once filled, a large set of water balloons can be heavy and cumbersome to transport, typically requiring buckets to transport the filled balloons from the water spigot to the desired "launching" locations. Loading many water balloons into one carrier invariably leads to more balloon leakage and loss due to pressures from neighboring balloons. Also, since the water balloons are typically concentrated in only a few containers, this leads to players being in relatively close proximity to the containers and each other. As such, a potential for injury exists due to hard throws at close range.

Another significant issue with water balloon play is that it requires a significant investment of time and/or money to supply the filled balloons and deliver them. Then the duration of the actual throwing play only lasts until the majority of the balloons are broken. For players near a supply of filled water balloons, typical throw rates can exceed 26 balloons per minute. Thus, many balloons are required to extend play even for a fraction of an hour. Some players inevitably join late, or are away from a filled water balloon source at the start of play. Unfortunately, the fun play duration is typically very short, and approaching a filled water balloon source can put oneself into danger.

Most of the fun is generated from the breaking of balloons on other players, so even very under filled balloons are utilized to continue the play. These under filled balloons target a very small surface area and, due to their small size, can be thrown at high speeds, leading to an increase potential for injury. Also, the smaller size limits the ability of players seeing the balloons coming, leading to delayed reaction and potential face/eye hits. In addition, if stronger balloon materials are used to minimize breaks during inflation, those balloons will not break unless thrown hard; which can lead to additional harm.

Finally, when water balloon play ends, many broken balloon pieces are widely dispersed over an area. Even if the balloons are made of a biodegradable material, these pieces still represent an eyesore or stain to the view, with the possibility of an ingestion and digestion issue for any animals or pets that might cross the play region. Clean up can be quite tedious and time consuming.

Other alternative devices that replace water balloons include sponge-like devices that soak up water, and small crushable but refillable ball-like containers. Often, when these devices are thrown, the water is also released on the thrower due to the combination of rapid acceleration and the squeezing action of a throwing hand. Another deficiency is that only the small spot on a player is directly wetted upon contact by the ball-like device. The small delivery area also means that many throws miss their target and will need to be retrieved. Also, the highly concentrated impact may lead to injury if it is heavily loaded with water. Of course, if the device is not heavily loaded with water, then little water is delivered, diminishing its usefulness. Further, close range hits to the face or an eye can be dangerous.

Therefore, a need exists for an improved amusement apparatus and system for delivering water toward a person.

SUMMARY OF THE INVENTION

The present invention is directed to an apparatus and method for collecting and tossing water for amusement. The present invention provides a series of improvements over conventional water-tossing methods, including: eliminating pre-play preparation and permitting immediate water throwing play; low cost play by avoiding the need to constantly replace play elements through the use of reusable water thrower; ease-of-play by allowing the use any water source, easy filling and refilling, and simple actuation; and exciting play by allowing for many hits (less misses) with rain-like hits.

In an embodiment, the water dispenser also is configured to float through the air, thereby allowing it to be caught as part of the play. This increases the diverse games that can be played with the dispenser, including a combination of throwing, running and catching.

The present invention eliminates the issues with the prior art balloons that, at times, do not burst by providing a system where every throw results in a water burst—burst in-air, or on-target.

The present invention also allows for single player games, such as tossing the water dispenser vertically and then attempting to catch the dispenser before it contacts the ground.

The present invention also provides a relatively safer apparatus during use while throwing near others, and/or while carrying (including when one is running during play and could inadvertently fall.) The system also provides for safer water hits at all ranges since an enclosed container (such as a balloon or bag) does not impact the players. The water dispensing provides a soft, rain-like shower, covering a large area. The dispenser floats in air for easy player recovery.

The invention also reduces the amount of water that falls on the user and is ease to carry to and from the playing field and for storage.

Most importantly from an environmental aspect, the present invention does not leave any remnants, such as broken balloons that are an environmental hazard and eyesore, eliminating issues regarding ingestion/digestion by animals.

A toy apparatus is disclosed for throwing fluid. the apparatus includes a base made from substantially fluid-tight, flexible material, the base having an outer periphery; and a throwing handle configured to attach to or near the periphery of the base to provide support for the base when containing a fluid, at least a portion of the throwing handle being flexible. The flexible portion of the throwing handle is preferably attached to at least a portion of the periphery of the base. In an embodiment, the flexible portion of the throwing handle comprises mesh netting. In an embodiment, the base is preferably a flat circular shape.

In one embodiment, the base and throwing handle are configured to form the base into a parachute shape when filled with a liquid and lifted by the throwing handle.

In an embodiment, the throwing handle comprises a plurality of ribbon-like straps that are attached to spaced apart locations on the base.

The handle preferably includes at least one strap attached to a distal end of the mesh, the strap providing a grip for a user to grasp during use.

In an embodiment, the handle includes a plurality of strands of material that are attached to the periphery of the base.

The toy apparatus preferably includes a drag component having two ends, one end being attached to a location on the base. The drag component may include a weighted element that flexibly hangs below the base when the base is held by the handle. In one embodiment, the drag component has two ends, one end being attached to the handle at a location that is not aligned with the center of the base when the base is laden with fluid and held by the handle.

The drag component may include an attached parachute.

The opposite end of the drag component preferably includes a wrist cuff for removably attaching to a user's wrist.

A method of throwing fluid as part of a game is also disclosed. The method involves the steps of using a toy apparatus as described in any of the embodiments, holding the handle and placing the base in a fluid reservoir, causing fluid to flow onto the base, lifting the handle so as to cause the base to form a scoop containing an amount of fluid, swinging the base with the fluid inside the scoop and releasing the handle, and causing the fluid to dispense from the base while in flight.

In an embodiment, the step of causing the fluid to flow onto the base involves dragging the base through the fluid reservoir to cause the base to deform and scoop up fluid.

In an embodiment, the step of causing the fluid to dispense involves creating drag through the use of a drag component connected to the base or handle to produce uneven loading on the base, leading to the release of the fluid.

In an embodiment, the step of causing the fluid to dispense involves creating an off-set loading on the base by a drag component attached to the base and the a wrist of the user.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE EMBODIMENTS

An example embodiment of a fluid throwing apparatus 10 includes a base member 14 that is made from substantially fluid-tight flexible material, for example, water-tight nylon, or other thin polymer material that can retain water. A handle 12 is attached to the base 14 and which is preferably flexible, pliable (or has limited rigidity), for example mesh, netting, strings or ribbons, or a flexible elongated plastic strip, which when attached to the base 14 causes the base 14 to form into a cup or scoop shape when it is at least partially filled with a fluid and held above the ground. When thrown, the fluid is carried by the base 14 and then released. Depending upon the use of the fluid throwing apparatus 10, the fluid release could be due to direct impact, or due to unstable flight of the system, such as deformation of the base or the momentum of the mass of fluid. In some embodiments the unstable flight may be induced by optionally attached drag components as discussed below.

The apparatus and method of the present invention for throwing fluid delivers many of the desirable fluid throwing advantages identified above. In addition, using an elastic drag component attached to a player's wrist enables a player to use the apparatus to scoop fluid, throw it, have the scoop snap back to them, and refill the scoop in seconds. Thus, the drag component acts as a rapid return mechanism, enabling rapid refill. Further, the flexible base section that forms the scoop when filled is preferably soft and configured to open rapidly thereby facilitating the release and dispersal of the fluid over a large area. This rapid release and wide dispersing lowers the force at the point of impact substantially while still accomplishing the goal of soaking the target. Further, the fluid is always released on every throw due to the construction of the apparatus. These features overcome many of the problems experienced by prior art.

Preferred Embodiments

This disclosure describes several example embodiments for implementing different features, structures, or functions of the fluid throwing system, including preferred embodiments components, arrangements, and configurations. These examples are provided to simplify the present disclosure. However, these preferred embodiments are provided merely as examples and are not intended to limit the scope of the invention.

Figure 1:
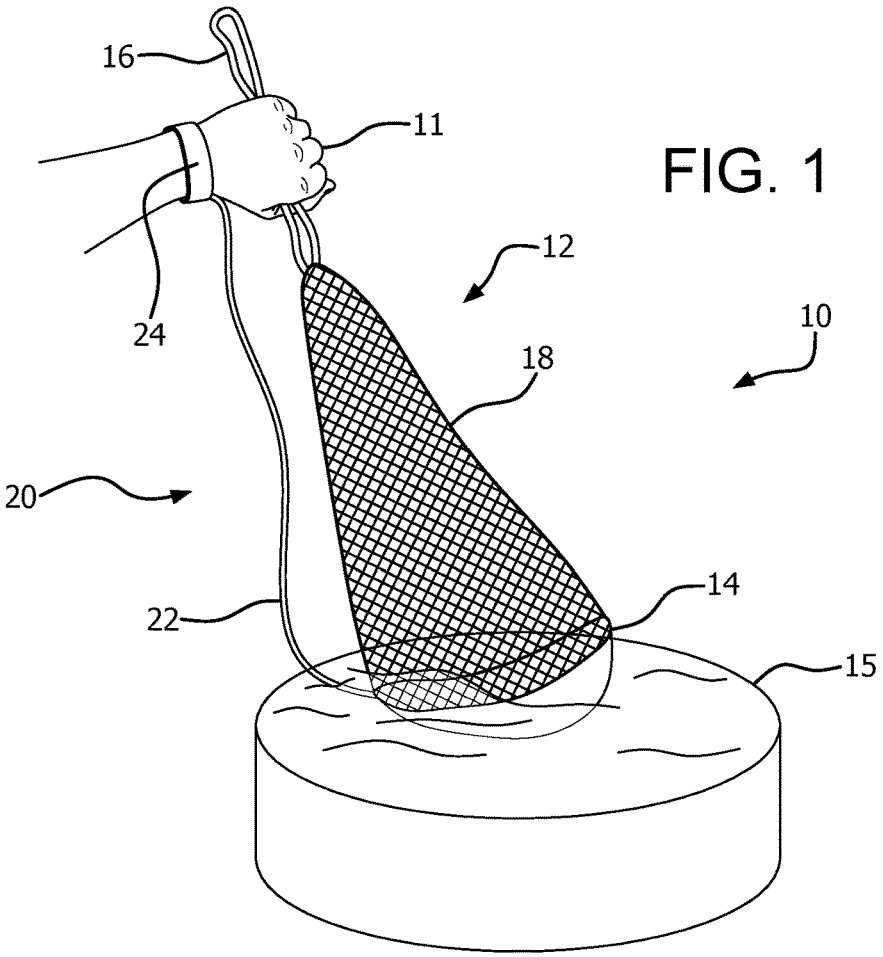
FIG. 1 illustrates an embodiment of a toy apparatus during use as it is being filled with a fluid.

FIG. 1 is a simplified diagram illustrating an embodiment of a fluid throwing system 10. In this embodiment, the handle 12 preferably includes a grip 22 and a flexible connector 18. The grip 12 is designed for grasping by a user (the thrower) and is preferably a soft material, such as foam or strap of material, and may be slightly stiffer than the flexible connector 18. In the illustrated embodiment, the flexible connector 18 is netting. Of course, it is also contemplated that the handle does not include a separate grip but, instead, the user grasps the end of the flexible connector 18. The flexible connector 18 is attached to the base 14. In use, the hand 11 of the thrower (user) grips the handle 12 to support and fold the flexible base 14 into a scoop or parachute shape for filling. Gravity pulls down on the material and causes the flat base material to deform in the middle and form a scoop; this analogous to an upside down parachute filling with air. The handles on the outside edge/rim of the base will hold up the rim, while the water weights down the middle of the base. The cupped substantially fluid-tight, flexible base 14 is placed into a fluid source 15 to capture water. To facilitate filling of the scooped base, the user can drag the base 14 against the fluid source 15 causing the fluid to flow onto the scoop shaped base. In an embodiment, the base 14 has an attached drag component 26 that will drag on the material of the base 14 when thrown, allowing the momentum of the fluid to cause it to release and dispense. The drag component 26 is, in one embodiment, a long elastic strap 22 with a wrist cuff 24 attached at one end that is removably attachable to the wrist of a user, such as with snaps or a hook and loop fastener, e.g., Velcro® brand fastener.

Figure 2:
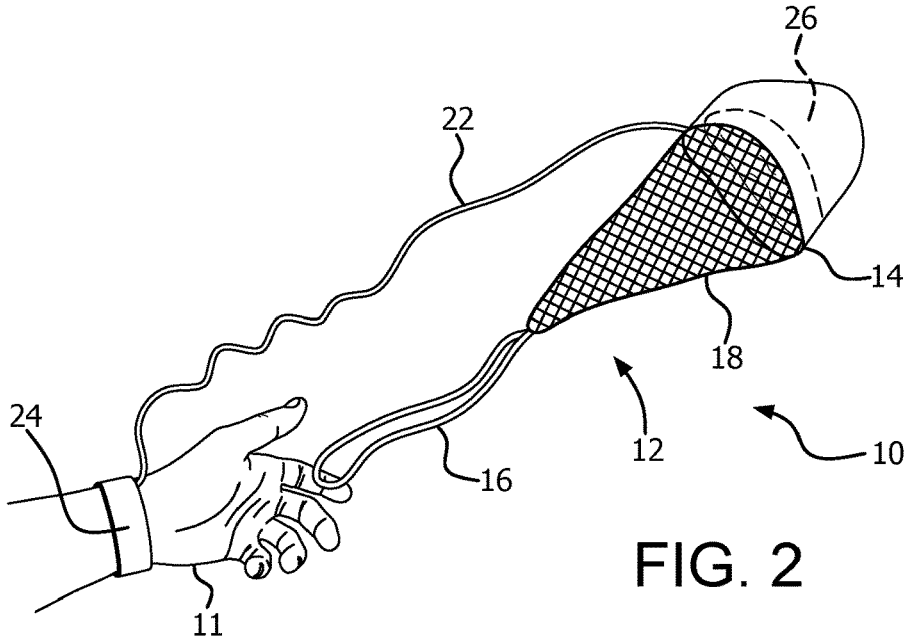
FIG. 2 illustrates an embodiment of the toy apparatus of FIG. 1 being released by a user during use.
Figure 3:
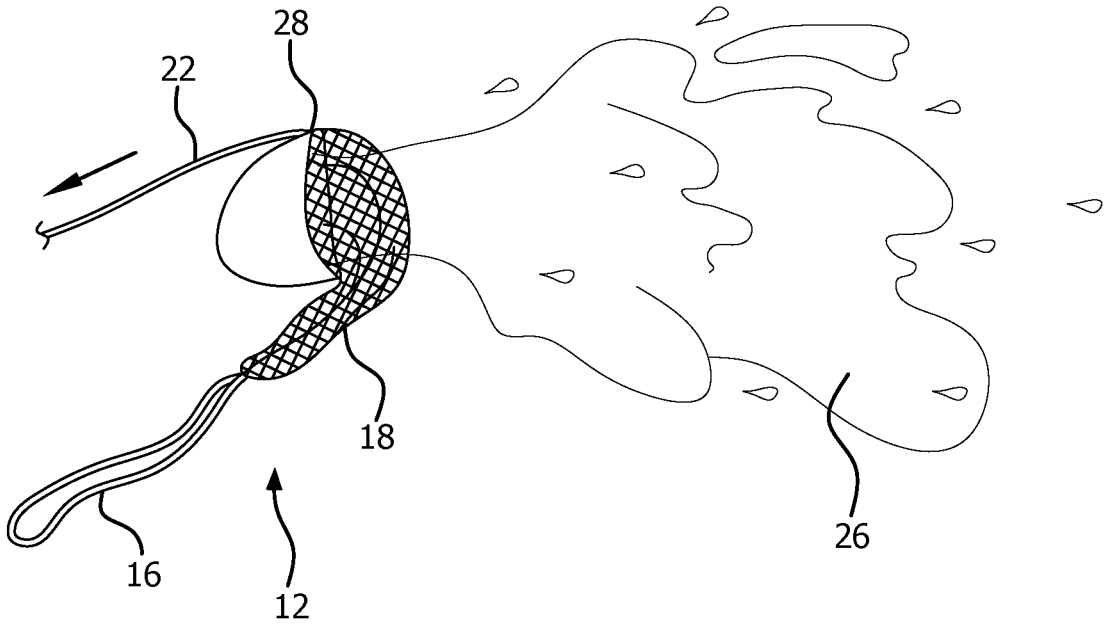
FIG. 3 illustrates an embodiment of the toy apparatus of FIG. 1 as the fluid is dispensed during use.

FIG. 2 illustrates an embodiment of the fluid throwing system 10 after being released by the user. At the end of the thrower's swing, the hand 11 of the thrower releases the handle 12. The momentum of the throwing action carries the cupped base section 14 forward while it holds fluid 26 in its scoop shape. Referring to FIG. 3, after release, the fluid filled base 14 will cause the strap 22 to stretch, while the drag of the strap 22, which is preferably attached to an edge 28 of the base 14, causes the base 14 to slow and slowly deform from its scoop shape, thereby releasing the fluid 26 as the material of the base 14 unfurls. See FIG. 3. The handle 12 flexes to minimally impede the forward motion of the fluid 26. The elasticity of the drag component 20 causes the rapid recovery of the base 14 and handle 12, thereby permitting reuse of the fluid throwing system.

Figure 4:
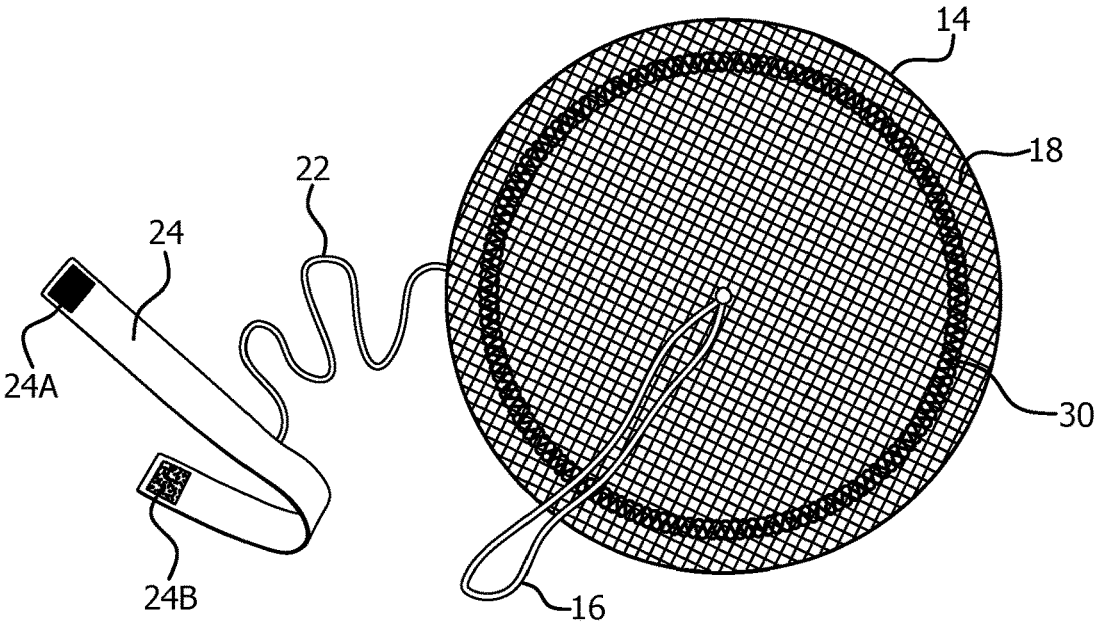
FIG. 4 illustrates an embodiment of the toy apparatus of FIG. 1 laying flat on a surface.

FIG. 4 illustrates an embodiment of the fluid throwing system 10 when it is not carrying a fluid and is in a stowed or storage state. In this embodiment, the material of the base 14 is non-deformed or flat when placed on a surface. As shown the lower flexible connector 18 of the handle, which in the illustrated embodiment is mesh, lies flat on top of the base 14. The lower flexible connector 18 can be attached to the base 14 through any conventional means, such as with rope or thread 30. The rope 30 could extend through eyelets or holes located around the periphery of the base 14 which would add some stiffness to the rim of the base. Alternatively, snaps could be used. The upper grip 16 is shown lying on top of the lower connector 18. The upper grip 16 preferably attaches to the lower flexible connector 18 near its center so as to provide an even distribution of the weight of the fluid when captured in the base, this limiting inadvertent tipping. As shown, the strap 22 of the drag component is attached to the edge 28 of the base 14. The other end of the strap 22 attaches to the wrist cuff or wrap 24 through the use of connectors 24A, 24B.

Figure 5:
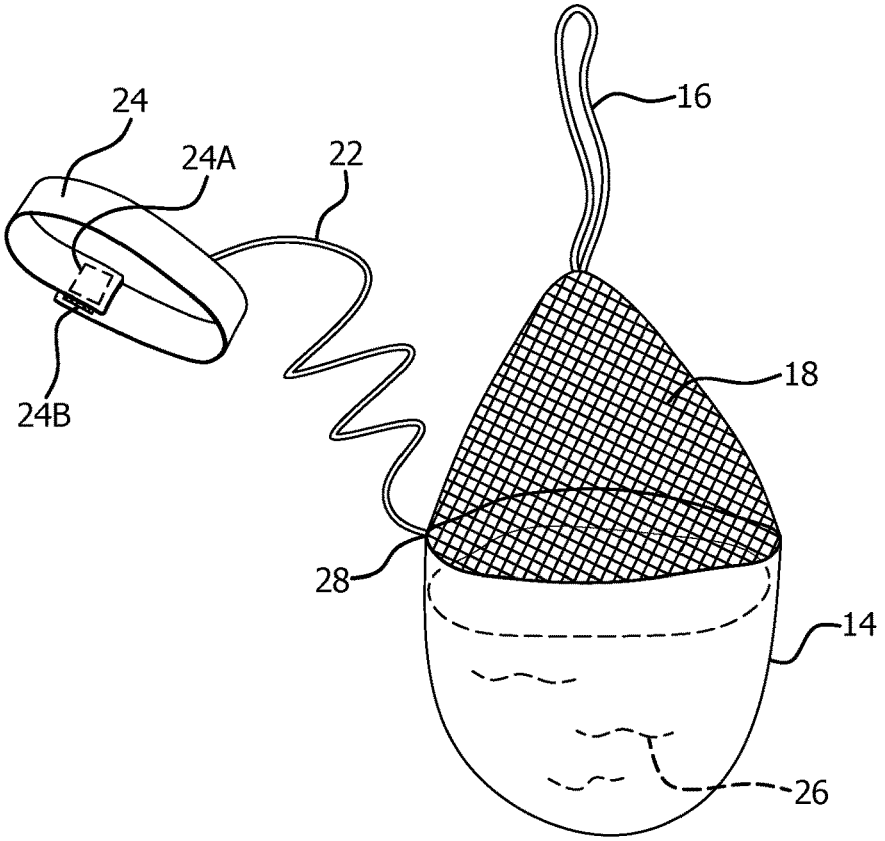
FIG. 5 illustrates an embodiment of the toy apparatus of FIG. 1 being held above the surface and containing a fluid.

FIG. 5 illustrates the fluid throwing system 10 carrying a fluid 26 as it is lifted off the ground, thus supporting the weight of the fluid 26. As shown, the base section 14 forms the cupped shape which holds the fluid 26. The handle is held by a user (not shown) and the lower connector 18 pulls up on the rim of the base 14. The strap 22 of the drag component is shown connected to the edge 28.

Figure 6:
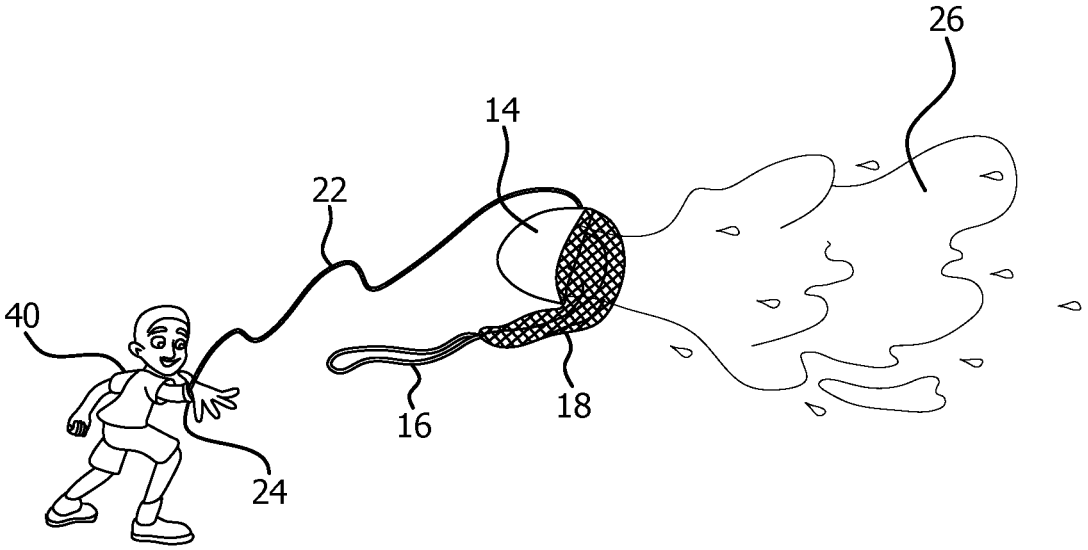
FIG. 6 illustrates an embodiment of the toy apparatus of FIG. 1 thrown a distance from a player during use.

FIG. 6 illustrates a method of use for any of the embodiments of a fluid throwing system 10. As shown a player 40 has the wrist cuff 24 attached to their wrist. When the player throws the system 10, the strap 22 of the drag component exerts force on the base 14 to slow its forward motion and momentum relative to the forward motion and momentum of the fluid 26. The fluid 26 proceeds forward, flowing out of the base 14.

Figure 7:
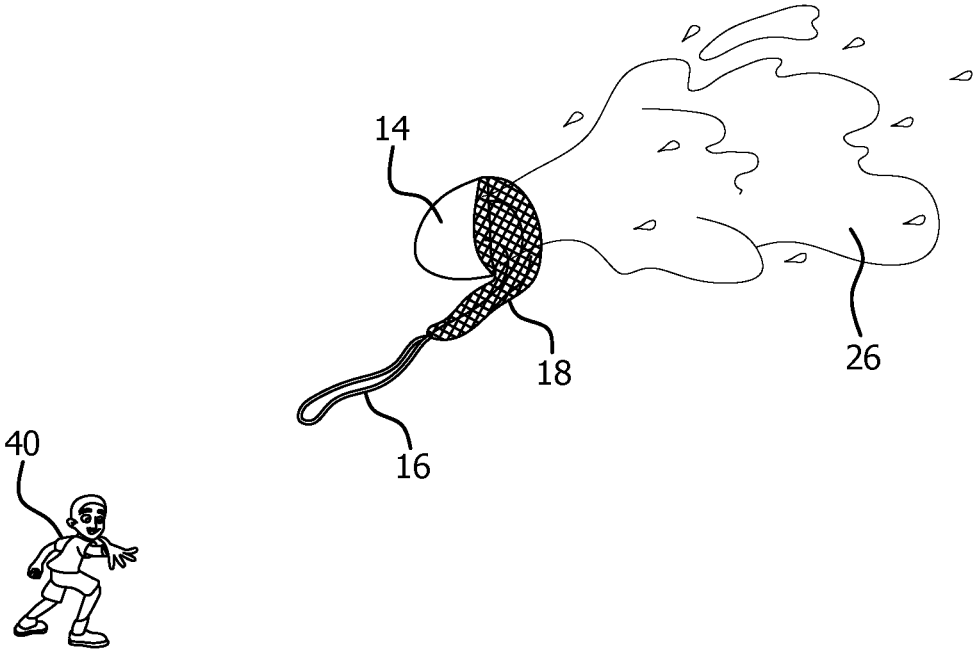
FIG. 7 illustrates an embodiment of the toy apparatus of FIG. 1 as it dispersing the fluid during use.

FIG. 7 illustrates another method of use for the throwing system 10. In this embodiment the player 40 does not have the drag component 20 attached to their wrist or the base 14. As the player 40 throws the system 10, the base experiences unstable flight which cases the base to unfold, releasing the fluid 26 and allowing it to dispense and disperse.

Figure 8:
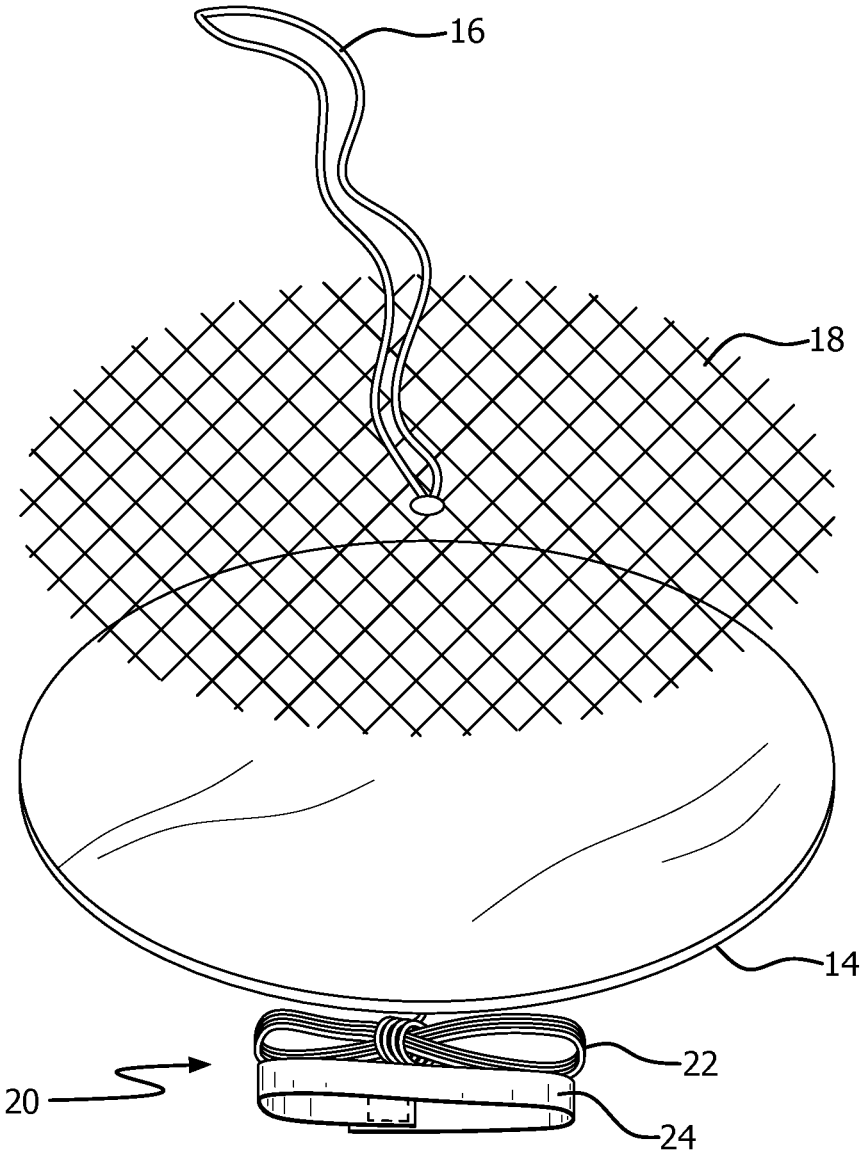
FIG. 8 illustrates an exploded view of an embodiment of the toy apparatus of FIG. 1.

FIG. 8 is an exploded illustration of an embodiment of the fluid throwing system 10 when it is not carrying a fluid. The substantially fluid-tight, flexible base 14 is shown flat and, in the illustrated embodiment, is circular in shape. Of course, other shapes may be used. The low flexible connector 18 is shown as a flat round mesh. While it is shown as having the same diameter as the base, that is not necessarily the case. In fact, the lower flexible connector 18 will, in most cases, be significantly larger than the base. The grip or upper portion 12 of the handle 12 is shown attached to the center of the lower connector 18. The user would attach the outer peripheral edge of the lower connector 18 to at least sections of the periphery of the base 14. The drag component 20 is attached to the edge 28 of the base and is shown rolled up.

Figure 9:
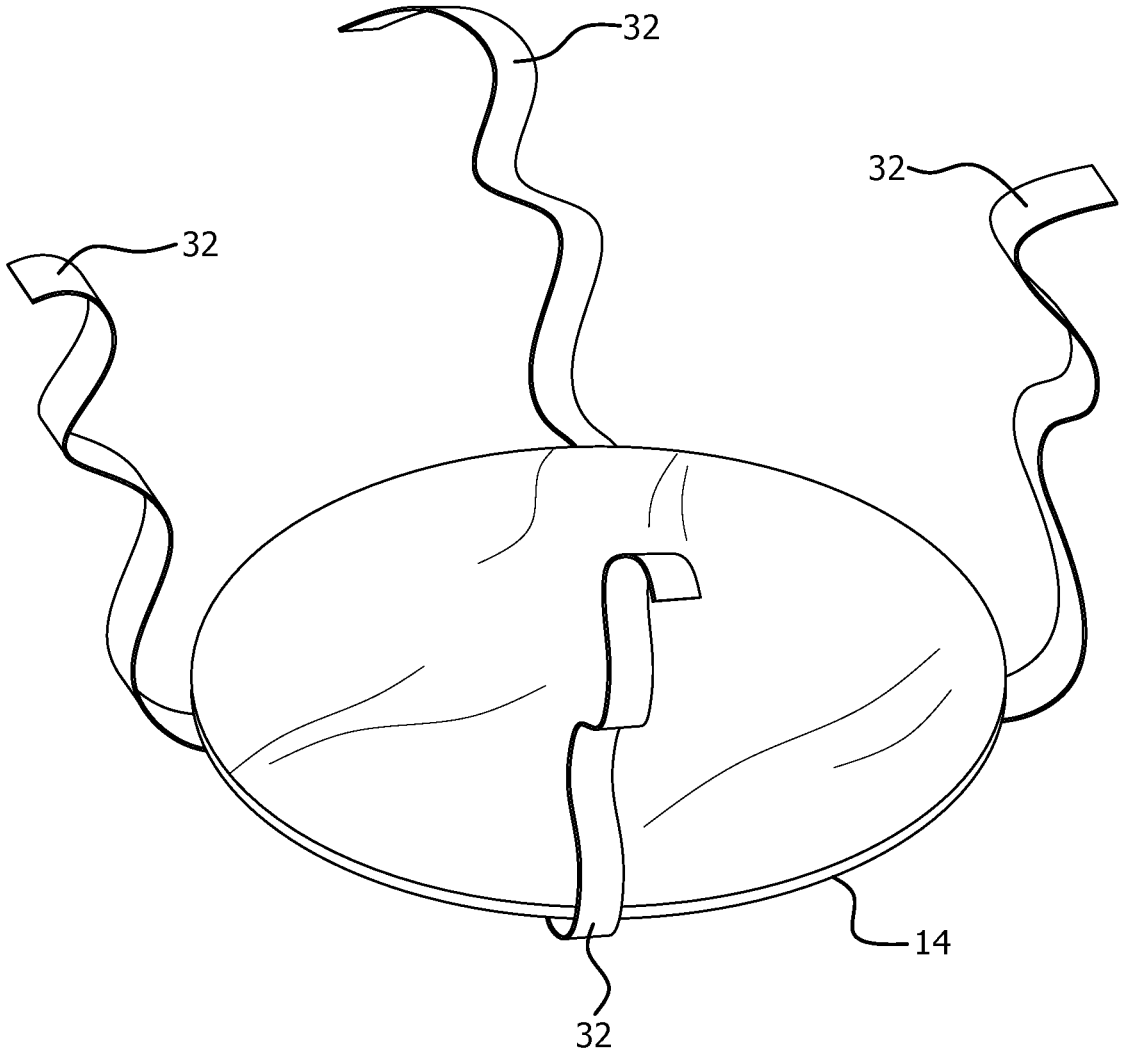
FIG. 9 illustrates another embodiment of the toy apparatus.

FIG. 9 illustrates another embodiment of a fluid throwing system 10. In this embodiment, the base is the same. The flexible connector 18, however, is a plurality of ribbon-like flexible strips 32 that attach to discrete points on the periphery of the base. Preferably the ribbons are equally spaced about the circumference of the base 14 so as to provide a stable, even loaded cup when the base contains water.

Figure 10:
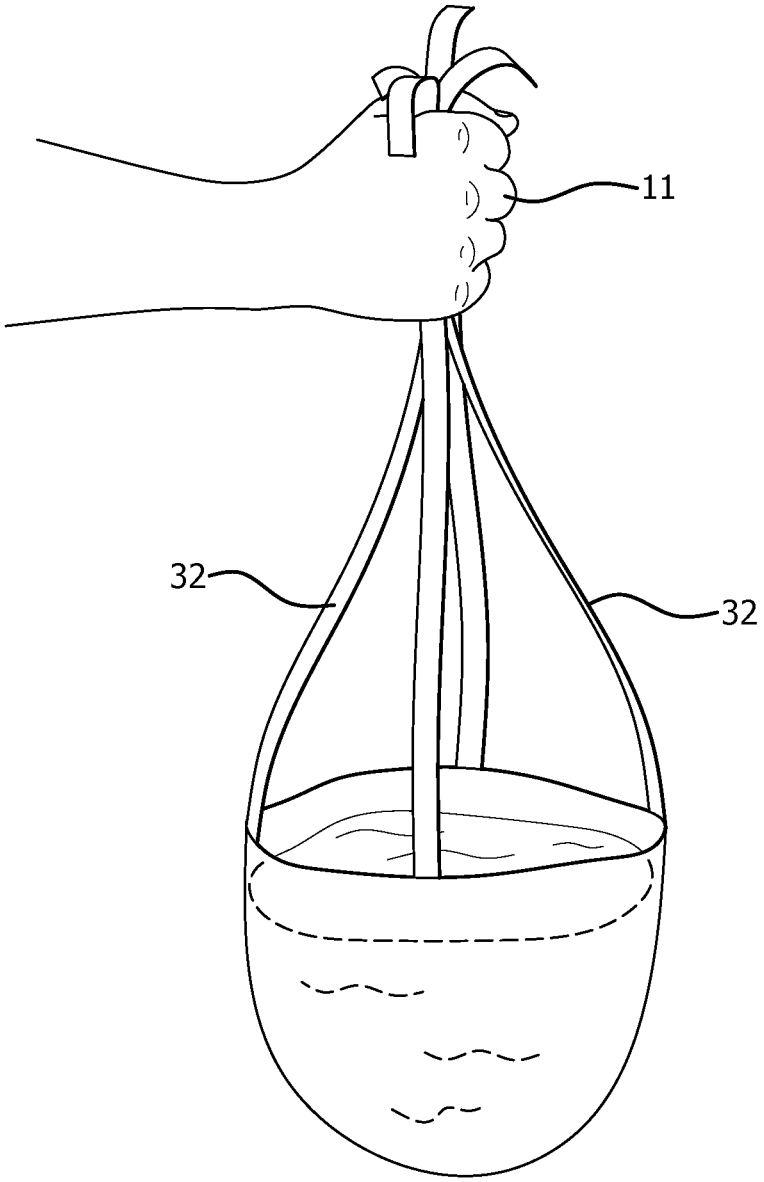
FIG. 10 illustrates the embodiment of the toy apparatus of FIG. 9 when laden with a fluid.

FIG. 10 illustrates the embodiment of the throwing system 10 of FIG. 9 containing a fluid. As shown, there is no grip or upper section of the handle. Instead, the lower connectors 32 define the entire handle and are gasped by the player's hand.

While the above discussion described the drag component as a strap or flexible element, it is contemplated that the drag component could include a weighted element that is flexibly attached to the base. Instead of exclusively using drag to hold back an edge/rim of the base material, a weight (discrete or continuous along the length) could be used to accelerate or decelerate that weight attachment point on the rim of the base, relative to the rest of the base, causing deformation of the base scoop sufficient to release the fluid/water. Alternately, it is contemplated that the drag component may include a parachute or similar means for adding drag (beyond the strap itself. While the drag component is shown as being attached to the edge 28 of the base, it is contemplated that the drag component can be attached to any location that is preferably not on the center-of-gravity of the base laden with water.

In addition, while the invention has been described as having the drag component attached to the base, it is also contemplated that the drag component could, instead, be attached to the handle.

As discussed above, for the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

What is claimed is:

1. A toy apparatus for throwing fluid, the apparatus comprising:

a base made from substantially fluid-tight, flexible material, the base having an outer periphery;

a throwing handle configured to attach to or near the periphery of the base to provide support for the base when containing a fluid, at least a portion of the throwing handle being flexible; and a drag component having two ends, one end being attached to a location on the base, and the other end includes a wrist cuff for removably attaching to a user's wrist, wherein the drag component is separate from the throwing handle and does not support the base when the base contains a fluid.

2. The toy apparatus of claim 1 wherein the flexible portion of the throwing handle is attached to at least a portion of the periphery of the base.

3. The toy apparatus of claim 2 wherein the flexible portion of the throwing handle comprising of mesh netting.

4. The toy apparatus of claim 3 wherein the handle further includes at least one strap attached to a distal end of the mesh, the strap providing a grip for a user to grasp during use.

5. The toy apparatus of claim 2 wherein the throwing handle comprises a plurality of ribbon-like straps that are attached to spaced apart locations on the base.

6. The toy apparatus of claim 1 wherein the base is a flat circular shape.

7. The toy apparatus of claim 1 wherein the base and throwing handle are configured to form the base into a parachute shape when filled with a liquid and lifted by the throwing handle.

8. The toy apparatus of claim 1 wherein the handle comprises a plurality of strands of material that are attached to the periphery of the base.

9. The toy apparatus of claim 1 wherein the end of the drag component that is attached to the base is attached at a location that is not aligned with the center of the base when the base is laden with fluid and held by the handle.

10. The toy apparatus of claim 9 wherein the drag component includes an attached parachute.

11. A toy apparatus for throwing fluid, the apparatus comprising:

a base made from substantially fluid-tight, flexible material, the base having an outer periphery;

a throwing handle configured to attach to or near the periphery of the base to provide support for the base when containing a fluid, at least a portion of the throwing handle being flexible; and a drag component having two ends, one end being attached to a location on the base, wherein the drag component includes a weighted element that flexibly hangs below the base when the base is held by the handle.

12. The toy apparatus of claim 11 wherein the other end of the drag component includes a wrist cuff for removably attaching to a user's wrist.

13. The toy apparatus of claim 11 wherein the flexible portion of the throwing handle is attached to at least a portion of the periphery of the base.

14. The toy apparatus of claim 13 wherein the flexible portion of the throwing handle comprising of mesh netting.

15. The toy apparatus of claim 11 wherein the handle comprises a plurality of strands of material that are attached to the periphery of the base.

16. The toy apparatus of claim 11 wherein the one end of the drag component that is attached to the base is attached at a location that is not aligned with the center of the base when the base is laden with fluid and held by the handle.

17. A method of throwing fluid as part of a game, the method comprising the steps of:

providing a toy apparatus comprising a base made from substantially fluid-tight, flexible material, the base having an outer periphery, and a throwing handle configured to attach to or near the periphery of the base to provide support for the base when containing a fluid, at least a portion of the throwing handle being flexible;

holding the handle and placing the base in a fluid reservoir;

causing fluid to flow onto the base;

lifting the handle so as to cause the base to form a scoop containing an amount of fluid;

swinging the base with the fluid inside the scoop and releasing the handle; and causing the fluid to dispense from the base while in flight.

18. The method of claim 17 wherein the step of causing the fluid to flow onto the base involves:

dragging the base through the fluid reservoir to cause the base to deform and scoop up fluid.

19. The method of claim 17 wherein the step of causing the fluid to dispense involves creating drag through the use of a drag component connected to the base or handle to produce uneven loading on the base, leading to the release of the fluid.

20. The method of claim 17 wherein the step of causing the fluid to dispense involves creating an off-set loading on the base by a drag component attached to the base and the a wrist of the user.

* * * * *